US005833335A

United States Patent [19]

Voughlohn

[11] Patent Number: 5,833,335

[45] Date of Patent: Nov. 10, 1998

[54] HAIR-STYLING METHODS AND HAIR-STYLING DEVICE

[76] Inventor: Dee Voughlohn, 1280 NW. 18th, Corvallis, Oreg. 97330

[21] Appl. No.: 5,713

[22] Filed: Jan. 12, 1998

Related U.S. Application Data

[60] Provisional application No. 60/035,422 Jan. 13, 1997.

[51] Int. Cl.[6] ..... A45D 8/04; A45D 8/34; A45D 8/36

[52] U.S. Cl. ..... 132/273; 132/275; 132/279; 132/212; 132/200

[58] Field of Search ..... 132/212, 273, 132/275, 276, 278, 279, 200; 24/487, 499, 545; 2/174, 198, 181; 63/11

[56] References Cited

U.S. PATENT DOCUMENTS

| | | | |
|---|---|---|---|
| 1,135,745 | 4/1915 | Wenzlick | 132/279 |
| 1,146,934 | 7/1915 | Gleeson | 132/273 |
| 1,241,337 | 9/1917 | Breitenstein | 132/275 |
| 2,011,194 | 8/1935 | Eisler | 132/275 |
| 5,036,870 | 8/1991 | Edmark | 132/273 |
| 5,186,186 | 2/1993 | Hamilton | 132/275 |
| 5,230,355 | 7/1993 | Weingrod | 132/273 |
| 5,289,834 | 3/1994 | Lawrence | 132/212 |
| 5,303,723 | 4/1994 | Schach | 132/246 |
| 5,494,059 | 2/1996 | Barrows et al. | 132/273 |
| 5,499,638 | 3/1996 | Ripley | 132/273 |

OTHER PUBLICATIONS

Brochure of 11 additional prior–art hair styles derived from the U.S. Patent above which is: 5,036,870 Aug. 6, 1991, Inventor Edmark Class 132 Subclass 273 filing date Oct. 10, 1989.

*Primary Examiner*—Gene Mancene
*Assistant Examiner*—Pedro Philogene

[57] ABSTRACT

A plurality of interacting hair fashioners are used to style hair. Each interacting hair fashioner comprises a predetermined strap, a predetermined base, and a predetermined opening. At least one end of each strap is releasably or permanently attached to a corresponding base, defining a corresponding opening therebetween. Each interacting hair fashioner can be made of a predetermined material, for example flexible or resilient material; reconfigurable material capable of being bent repeatedly without fracturing; or rigid material; or the like. At least two interacting hair fashioners are used to roll two hair groups in two opposite directions. Then, these two interacting hair fashioners are couple interlock the two hair groups together by being intertwined together or by using coupling device. Further, additional interacting hair fashioners can be used together with these two interacting hair fashioners to style additional hair. Further if desired, at least one predetermined dividing device can be attached to at least one interacting hair fashioner for dividing the respective hair into a plurality of smaller hair groups and for decorating the respective hair as an ornament.

24 Claims, 19 Drawing Sheets

HAIR-STYLING METHODS AND HAIR-STYLING DEVICE

REFERENCE TO PREVIOUSLY-FILED PROVISIONAL PATENT APPLICATION

Provisional Patent Application No. 60/035,422 was filed on Jan. 13, 1997 for the following present invention herein.

TECHNICAL FIELD OF THE INVENTION

The present invention comprises unique hair-styling methods and a unique hair-styling device named hair fashioner. For the purpose of explaining, in precise details, the process of the present invention, each group of hair strands or each collection of hair strands is called a hair group.

BACKGROUND OF THE INVENTION

Hair styling is an important part of personal grooming and appearance. Much time and money are spent preparing the appearance of a person's hair. An entire industry has developed full of products and services to fulfill this demand.

As the pace of life continues to accelerate, as hair styles continue to evolve, and as financial pressures are felt everywhere, there is an ever-increasing demand for quicker, easier, and more cost-effective hair styles which are new, unique, and attractive.

Also, there is an ever-increasing desire to create easy and time-efficient hair styling devices so that the new, unique, and attractive hair styles can be changed easily within the day for different situations and for reflecting the mood of the user without the need for attending a professional salon.

Further, also there is an ever-increasing desire for:

eliminating the problem of headaches caused by pressure against the head when the head is used as a locking means to secure the hair styles and hair-styling devices which push against the user's head, and may cause unnecessary hair damage and headache during or after repeated or periodic uses;

eliminating the problem of stray hair strands;

eliminating the problem of hair styles which gradually come undone when secured with devices such as pins, clips, or the like.

Therefore, a need exists for versatile, inexpensive, compact, comfortable, self-secured, easy and quick-to-use devices and methods which can be applied for extended periods without damaging hair or causing headache, and which assist in the creation of many new, unique, and attractive hair styles which look professional yet require a minimum amount of time, money, and storage space.

Up until this time, many inventions have introduced a number of different hair styling devices and methods. However, all these inventions teach a user how to style and secure each hair group independently. Further, all these inventions either use the user's head as a locking means to secure each of the desired hair styles, or use additional hair-holding devices such as pins, clips, or the like to secure each of the desired hair styles, and all these inventions have a numerous disadvantages. Therefore, all these inventions teach away from the present invention.

In contrast, the present invention teaches the user how to style and couple a plurality of hair groups to interlock the plurality of hair groups together, creating a wide variety of new, unique, and attractive hair styles never possible before. Therefore, these hair groups interact with one another and are self-secured. As a result, the present invention eliminates the need for using the user's head as a locking means to secure each of the desired hair styles, and also eliminates the need for using additional hair holding devices such as pins, clips, or the like to secure each of the desired hair styles.

The hair styling devices and methods in U.S. Pat. Nos. 5,494,059 issued Feb. 27, 1996, in 5,303,723 issued Apr. 19, 1994, and in 5,499,638 issued Mar. 19, 1996 facilitate incorporating a hair group with a hair styling device, and rolling the hair-styling device on one side of the hair group toward the user's head to wind the hair group around the hair-styling device until the hair group is tight against the head. Then, one of the following techniques 1) and 2) is applied to secure the hair group independently:

1) First technique-using the user's head as a locking means:

Two ends of the device are bent around and brought together on the opposite side of the hair group, and are twisted together to secure the desired hair style; or at least one end of the device is bent around to the opposite side of the hair group enclosing the hair group to secure the desired hair style.

As the result, the unwinding force of the tightly-wound hair group unrolls the device and the bent-around end or ends of the device. Thus, the bent-around end or ends of the device push against the user's head. The user's head acts as a locking means, blocking and preventing the bent-around end or ends of the device from unrolling, to secure the device and the desired hair style. Therefore, the unwinding force of the tightly-wound hair group creates a considerable pressure against the user's head.

These disadvantages, during or after repeated or periodic uses, result in:

blocking the blood flowing under the user's head skin;

causing undue pain, discomfort, and headache;

2) Second technique-using additional hair-holding devices such as pins, clips, or the like:

Additional hair holding devices such as pins, clips, or the like are then inserted around or along the hair styling device to secure the desired hair style. This technique also creates numerous disadvantages during or after repeated or periodic uses as follows:

additional hair-holding devices such as pins, clips, or the like are unsightly, are subject to losing the section of hair intended to be held, pull on the hair and the hair roots, and therefore damage the hair;

stray hair strands appear, messing up or diminishing the desired hair style and often requiring the desired hair style to be redone;

the desired hair style undoes itself, sags down, looks unfinished and therefore unattractive;

additional facilities are needed to manufacture additional hair-holding devices such as pins, hair clips, or the like, and these costs are passed along to the user.

Further, in order for these hair-styling devices to be bent around the hair group to secure a desired hair style, these devices have to be made substantially longer than the width of the hair roll of the desired style. Further, in order to add fullness to a desired hair style, these hair-styling devices have to be made substantially large in diameter. Further, in order to use these hair-styling devices with enough hair to sufficiently cover these devices and to efficiently secure a desired hair style in place, the user has to have substantially long and thick hair.

The longer and larger hair styling devices create additional disadvantages of extra material, larger molds, extra weight, extra storage space, extra manufacturing costs, and the requirement of having substantially long and thick hair.

In contrast, the hair fashioners of the present invention solve these disadvantages with a more compact design and which will work with either long, short, thick, thin, straight, or curly hair. In addition, these above-mentioned inventions teach the user how to style and secure each hair group independently. Therefore, these above-mentioned inventions teach away from the present invention.

In contrast, the present invention facilitates creating a new variety of unique and attractive hair styles whose partially or fully wound hair groups are coupled together to interlock one another, and therefore interact with one another and are self-secured. At the same time, the present invention:

- eliminates the pressure created by the hair-styling devices of the above-mentioned inventions pushing against the user's head to secure desired hair styles;
- eliminates the need for using additional hair-holding devices such as pins, hair clips, or the like, to secure desired hair styles;
- eliminates undue cost for additional facilities to manufacture additional hair-holding devices such as pins, hair clips, or the like.
- eliminates undue pain, discomfort, headaches, and the cost of medical treatment for these problems.

OBJECTS AND ADVANTAGES OF THE INVENTION

Accordingly, several objects and advantages of the present invention are:

- The versatile hair fashioner can either be worn on the user's head, totally hidden under hair or partially exposed as an ornament, after creating each of a variety of new, unique, and attractive hair styles.
- The hair fashioners are capable of creating a variety of new, unique, and attractive hair styles never before possible and the wound hair groups of these hair styles are interlocked with one another, and therefore interact with one another and are self-secured, without causing headache or damaging the hair.
- The hair fashioners are capable of being bent, reconfigured, or made into a wide variety of different shapes to form a variety of new, unique, and attractive hair styles.
- The present invention eliminates the need for additional hair holding devices such as pins, hair clips, or the like to secure the desired hair styles. Therefore, there is no stray hair strands and the hair styles do not come undone nor sag down nor look unfinished throughout repeated or periodic of use. As a result, the present invention eliminates the need for the additional facilities to manufacture the additional hair-holding devices such as pins, hair clips, or the like, thus eliminating the undue additional cost involved;
- The present invention eliminates the need to use the user's head as a locking means to prevent the hair fashioners and the hair groups from coming undone. Therefore, there is no pressure against the user's head from the hair fashioners while the hair styles are worn. Consequently, the hair fashioners eliminate undue headache and medical cost for treatment involved;

OTHER OBJECTS AND ADVANTAGES OF THE PRESENT INVENTION

Other objects and advantages of the present invention are:

- The user specially has the choice of wearing the new, unique, and attractive hair styles with the wound hair groups either laying away from or laying next to the user's head;
- Also, the user specially has the choice of wearing the hair styles with the hair groups either wound loosely so that the hair gracefully drapes into a relaxed style or wound tightly in place forming a firmer style;
- To secure the desired hair styles, the hair fashioners interlock one another. Thus, they do not need to be made longer than the width of each hair roll of the desired hair styles to secure the desired hair styles. Therefore, they can be made compact, saving otherwise additional material, weight, storage space, and cost;
- To add fullness to the desired hair styles, the hair fashioners can bubble away from the head creating a gap between the hair fashioners and the user's head. Therefore, the user can specially wear the styled hair groups away from the head. And therefore, the hair fashioners can add additional fullness to the desired styles without the need to be made larger in diameter and without adding additional material, weight, storage space, and cost;
- The user has the choice of wearing the styled hair groups next to or away from the head;
- The present invention facilitates creating a wide variety of new, unique, and attractive hair styles including hair styles having no hair tail nor hair loop, hair styles having a hair tail or hair tails, and hair styles having a hair loop or hair loops;
- The hair fashioners can fasten foreign, separate hair groups to the hair group from the user's head for styling. The foreign, separate hair groups can be made of artificial or real hair;
- The new, unique, and attractive hair styles can be created easily and quickly by persons of almost any age, are free of stray hair strands, look professional, and are secured in place throughout repeated or periodic uses;
- The hair fashioners can also be used as a hair ornament;
- The hair fashioners are comfortable and wearable for extended periods;
- The new, unique, and attractive hair styles can be changed easily within the day for different situations and to reflect the mood of the user without the need for attending a professional salon;
- The hair fashioners are versatile, inexpensive, compact, comfortable, and are easy and quick to use. Therefore, the present invention saves time, money and storage space;
- The hair fashioner can lock a hair group at any point between the end and the root of the hair group;
- A hair group can be wound partially or fully around the hair fashioner to cover the hair fashioner partially or fully, respectively;
- The gap between two adjacent hair fashioners can be adjusted, thus the gap between two adjacent wound hair groups can be adjusted to accommodate any hair thickness;
- The hair fashioners can be used with long, short, thick, thin, straight, or curly hair, and can be used with any hair texture;

Further objects and advantages of the present invention will become apparent from a consideration of the drawings and ensuing description.

SUMMARY OF THE INVENTION

In accordance with one aspect of the present invention, a plurality of interacting hair fashioners are used together to style hair. Each interacting hair fashioner comprises a predetermined strap having at least one end releasably or permanently attached to a predetermined base, defining a predetermined opening therebetween.

In accordance with another aspect of the present invention, each interacting hair fashioner is preferably formed of resilient, flexible, or stretchable material such as copper, bronze, steel, paper, leather, rubber, foam, cork, cardboard, wood, fabric, cotton, elastic, vinyl, nylon, various plasticized material, plastic (for example, polypropylene), etc., or the like; or reconfigurable, twistable material which is able to be bent, reconfigured, or twisted repeatedly without fracturing such as copper, bronze, steel, plastic, etc., or the like.

In accordance with another aspect of the present invention, a plurality of interacting hair fashioners are provided for styling a plurality of hair groups to create a wide variety of many new, unique, and attractive hair styles and the wound hair groups are interlocked together. Therefore, these hair groups interact with one another, and are self-secured. These hair styles are retained by wearing these interacting hair fashioners on the user's head.

In accordance with another aspect of the present invention, unique methods of styling hair are provided, using a plurality of interacting hair fashioners to create a wide variety of many new, unique, and attractive hair styles. One of the methods includes the following steps:

First, insert the first hair group through the opening of the first interacting hair fashioner;

Next, roll the first interacting hair fashioner in either direction, toward head, to wind the first hair group partially or fully around the first interacting hair fashioner;

Next, insert the second hair group through the opening of the second interacting hair fashioner;

Next, roll the second interacting hair fashioner in the opposite direction from that of the first interacting hair fashioner, toward head, to wind the second hair group partially or fully around the second interacting hair fashioner; and Then, couple the first and second interacting hair fashioners together by intertwining one end of the first interacting hair fashioner and one end of the second interacting hair fashioner together or by using coupling means.

The unwinding forces of the first and second hair groups unwind the first and second hair groups respectively in two opposite directions, thus interlocking the first and second interacting hair fashioners together. Therefore, the first and second interacting hair fashioners secure each other and the first and second hair groups in place, thus creating a new, unique, and attractive hair style wherein the wound hair groups are interlocked together, and therefore interact with one another and are self-secured.

Further, the method teaches a user how to use at least one additional interacting hair fashioner together with the first and second interacting hair fashioners to style additional hair.

Further, the method teaches a user how to use at least one additional interacting hair fashioner together with the first and second interacting hair fashioners to style additional hair.

BRIEF DESCRIPTION OF THE DRAWINGS

A more complete understanding of the invention can be had by referring to the following Detailed Description, taken with the accompanying drawings, wherein.

DETAILED DESCRIPTION OF THE FIRST EMBODIMENT

Figure 1:
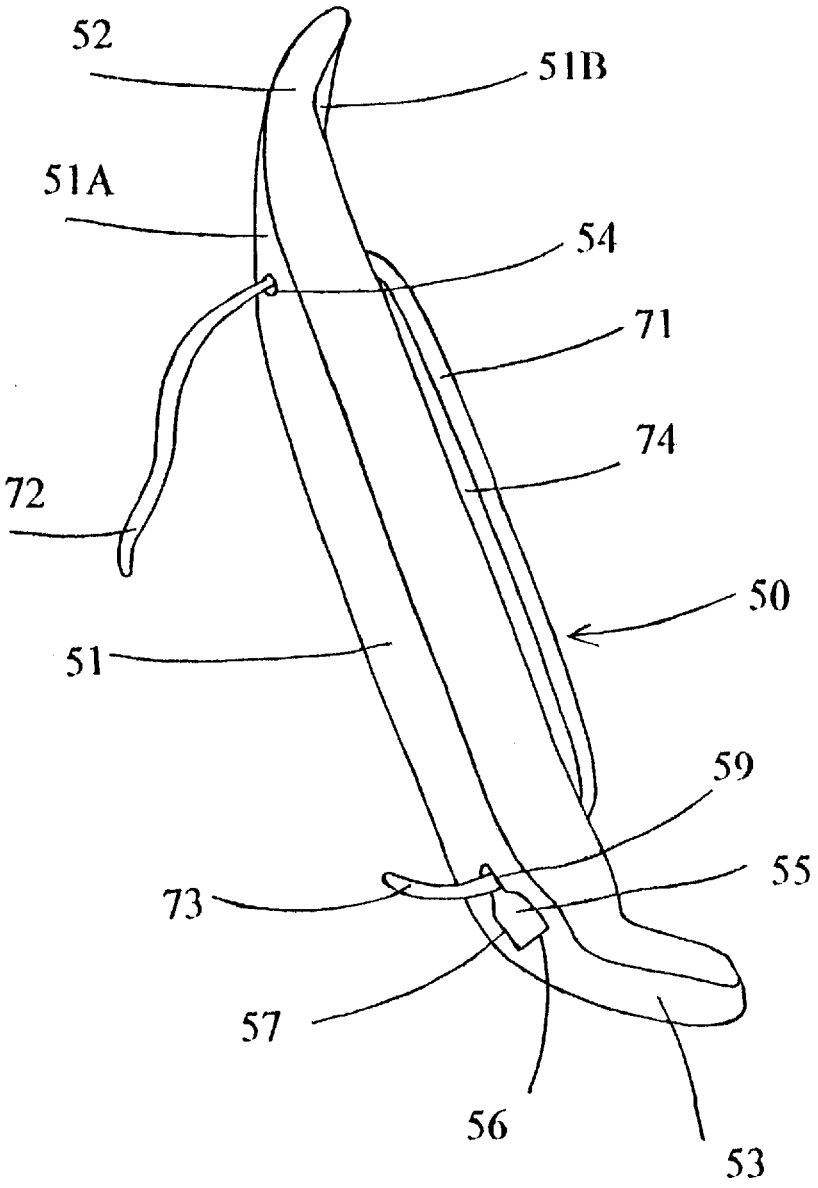
FIG. 1 is a perspective view of a hair fashioner forming a first embodiment of the present invention.

A first embodiment of a hair fashioner 50 comprises a fashioning base 51 and a fashioning strap 71 (FIG. 1):

Fashioning base 51 is preferably formed of flexible material which best allows it to conform to different head curves and different hair styles. Base 51 has side 51A, opposite side 51B, end 52, opposite end 53, first locking hole 54, second locking hole 55, and locking slot 59. Base 51 is curved and has a square cross-section. Base 51's cross-section decreases at both ends 52 and 53. Both ends 52 and 53 come to a point. Hole 54 extends from side 51A to opposite side 51B. Hole 54 is round. Hole 55 extends from side 51A to opposite side 51B. Hole 55 is rectangular and connected to locking slot 59. Hole 55 has width 56 and length 57. Slot 59 is rectangular.

Fashioning strap 71 is preferably formed of elastic material which best allows it, with its adjustable resilient force, to flatten and fasten a hair group against base 51. Strap 71 ends with tip 72 and opposite tip 73. Strap 71 has a round cross-section. The diameter of strap 71's cross-section is slightly bigger than the diameter of hole 54 and is also slightly bigger than the width of slot 59.

Ends 52 and 53 and tips 72 and 73 have been named only for the purpose of explaining the process of the invention and are not additional elements unto themselves. Ends 52 and 53 are part of base 51 and do not require any additional material. Tips 72 and 73 are part of strap 71 and do not require any additional material.

FUNCTION OF THE FIRST EMBODIMENT

Base 51 functions as a styling base to form hair volume and hair style. Base 51 also functions as a locking base to lock strap 71 in place. Ends 52 and 53 function as interlocking ends to interlock fashioner 50 with additional fashioners. Hole 54 and slot 59 function as locking holes to lock strap 71 in place. Hole 55 functions as an interlocking hole to interlock fashioner 50 with additional fashioners.

First, releasably press-lock tip 72 in hole 54 from either side 51A or 51B. Then, thread tip 73 through hole 55 from either side 51A or 51B, and releasably pull-lock tip 73 in slot 59. In this way, strap 71 is tightened and locked onto base 51, thus creating a fashioning opening 74. Fashioner 50 is now in locked position (FIG. 1).

Figure 2:
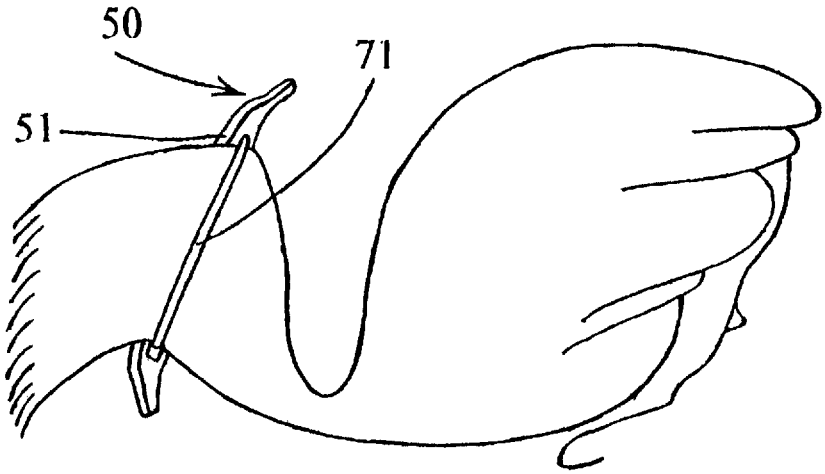
FIG. 2 illustrates how the hair fashioner fastens a hair group.

Consequently, when inserting a hair group through opening 74, strap 71, with its adjustable resilient force, flattens and fastens the hair group in opening 74 against base 51 (FIG. 2). Therefore, fashioner 50 can flatten and fasten the hair group at any point between the end and the root of the hair group, securely against base 51, and can prevent any hair strands from going astray from opening 74.

FUNCTION OF A PLURALITY OF HAIR FASHIONERS INTERACTING WITH ONE ANOTHER

Figure 3:
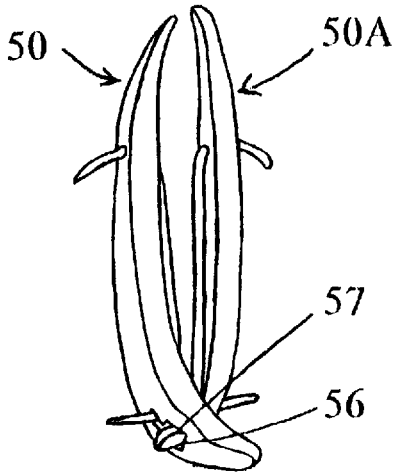
FIGS. 3, 4, 5, 6 illustrate various positions of coupling two hair fashioners.

Many hair fashioners can be operated and worn with paired hair groups to create a wide variety of unique wound hair styles. For the purpose of explaining the applications of the invention, an identical duplicate of fashioner 50 has been depicted as fashioner 50A (FIG. 3). Fashioners 50 and 50A function exactly in the same manner.

Figure 4:
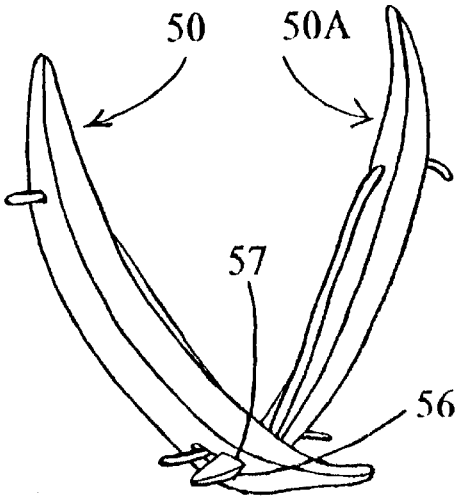
Figure 6:
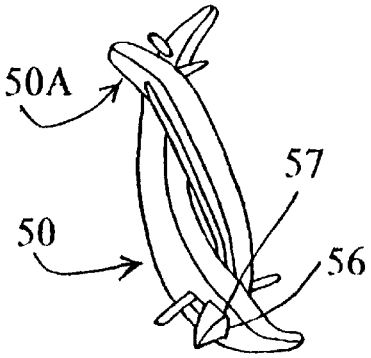

Width 56 and length 57 of hole 55 are each predeterminedly bigger than the cross-section's width at either end of fashioner 50A's base. Either end of fashioner 50A's base can be inserted into hole 55, from either side 51A or 51B, from many different angles, and to many different depths, to couple fashioners 50 and 50A with each other, in one of the following positions: (a) parallel to each other (for example: FIG. 3), (b) angular to each other (for example: FIG. 4), (c) linear to each other (for example: FIG. 4), or (d) across each other (for example: FIG. 6).

METHOD FOR USING A PLURALITY OF HAIR FASHIONERS OF FIRST EMBODIMENT

Figure 7A:
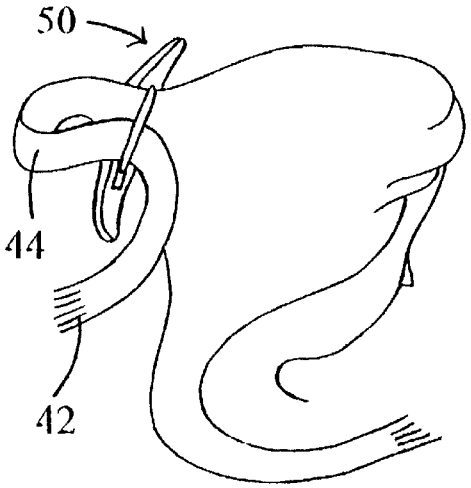
FIGS. 7A–7F, 8A–8J illustrate the use of two hair fashioners to create a variety of unique wound hair styles.
Figure 8A:
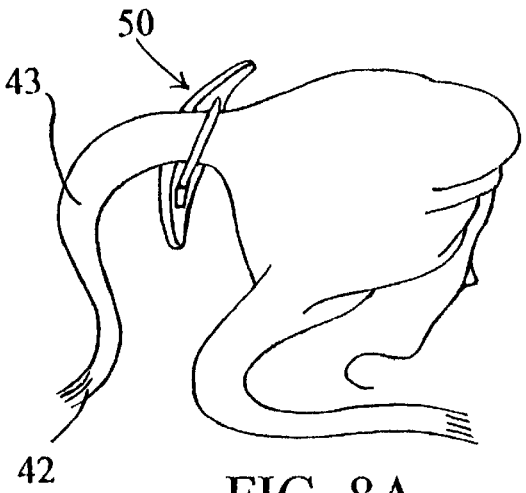

Hair fashioners 50 and 50A are in locked position (for example: FIG. 1). Two groups of hair strands are called first hair group and second hair group. Unique wound hair styles are created by the following steps:

1) Insert a portion of first hair group through opening 74 to flatten and fasten first hair group against base 51, in one of the following configurations:

(a) The end 42 of first hair group is not passed through opening 74 to form a hair loop 44 (for example: FIG. 7A); or (b) The end 42 of first hair group is passed through opening 74 to form a hair tail 43 (for example: FIG. 8A).

2) Roll fashioner 50 in either direction around its axis, toward the head, to wind first hair group partially or fully around fashioner 50 (for example: FIG. 7A results in FIGS. 7B or 7C); (for example: FIG. 8A results in FIGS. 8B or 8C).

3) Repeat steps (1) and (2) to apply the same styling techniques above but instead to fashioner 50A and second hair group so that fashioner 50A is rolled in the opposite direction from that of fashioner 50.

(First and second hair groups do not have to be wound tightly around fashioners 50 and 50A respectively, nor do fashioners 50 and 50A have to be rolled all the way up against the head, nor do either base end of fashioner 50 and either base end of fashioner 50A have to be bent through the hair groups, around the hair groups, or against the head).

Figure 7B:
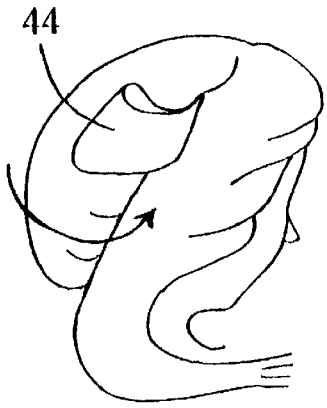
Figure 7C:
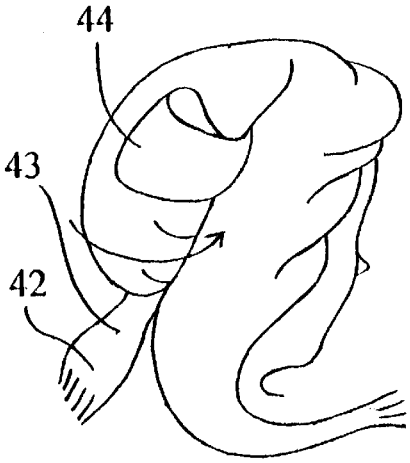
Figure 8B:
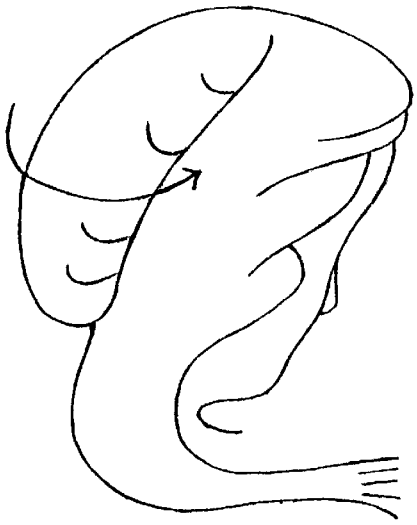
Figure 8C:
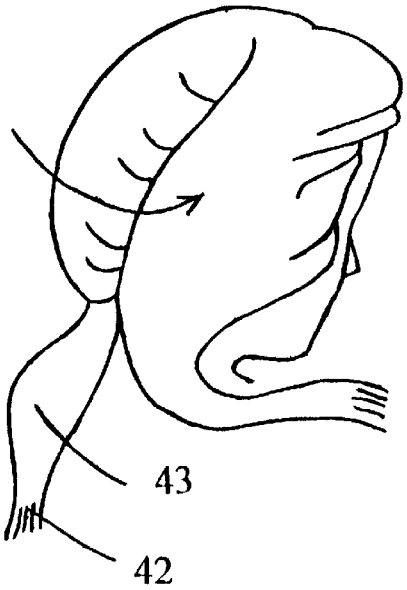
Figure 7D:
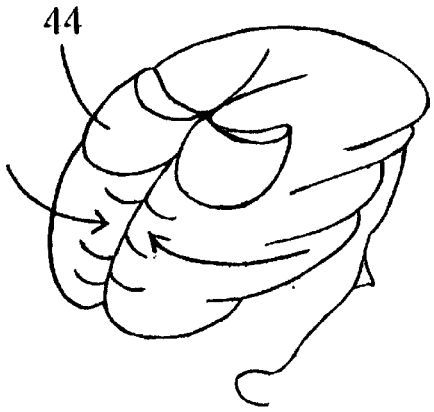
Figure 7E:
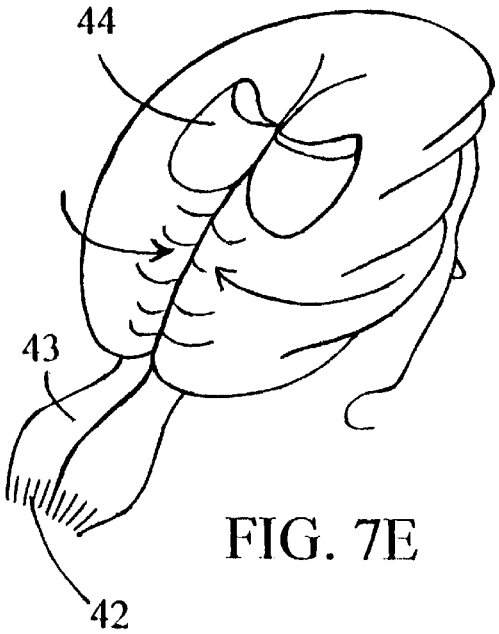
Figure 8D:
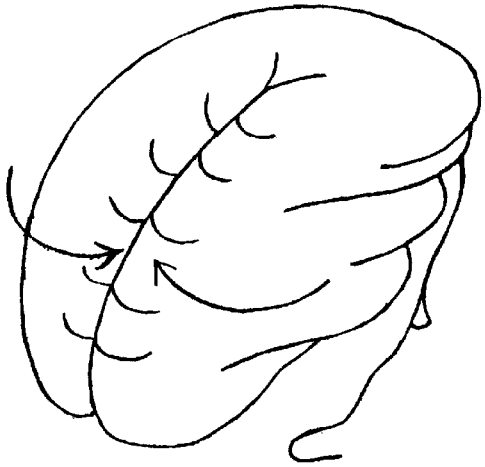
Figure 7F:
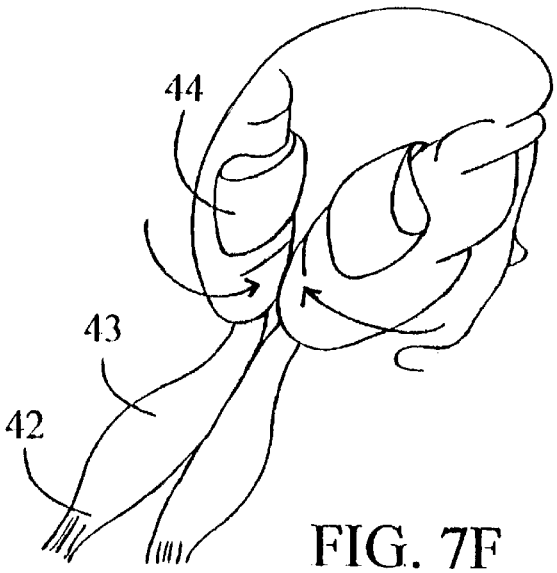

4) Position fashioners 50 and 50A, with respect to each other, in one of the following positions:

(a) Parallel to each other (for example, FIG. 7B results in FIG. 7D; FIG. 7C results in FIG. 7E; FIG. 8B results in FIG. 8D), (for example, FIG. 8C results in FIG. 8G, where first and second hair groups face each other); (for example, FIG. 8C results in FIG. 8H, where second hair group overlays first hair group); (for example, FIG. 8B results in FIG. 8I, where first and second hair groups stay side by side), (b) Angular to each other (for example, FIG. 7C results in FIG. 7F), (c) Linear to each other (for example, FIG. 8B results in FIG. 8E), or (d) Across each other (for example, FIG. 8C results in FIG. 8F).

5) Insert an end of fashioner 50A's base into hole 55 to couple fashioners 50 and 50A with each other. The unwinding forces of first and second hair groups unwind first and second hair groups respectively in opposite directions, thus interlocking fashioners 50 and 50A with each other.

Figure 5:
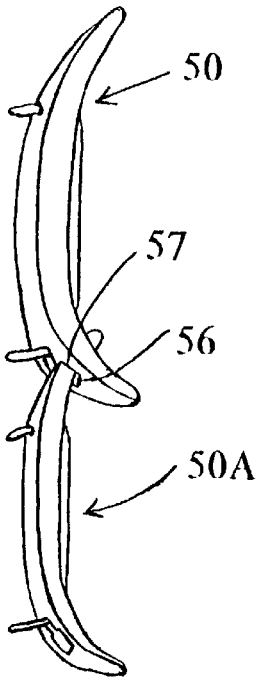
Figure 8G:
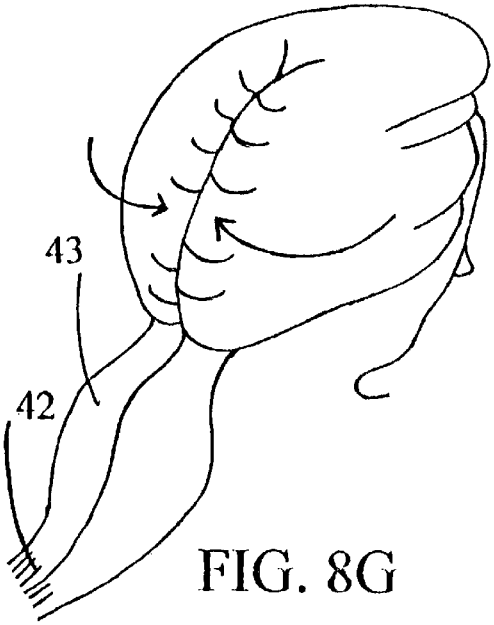
Figure 8H:
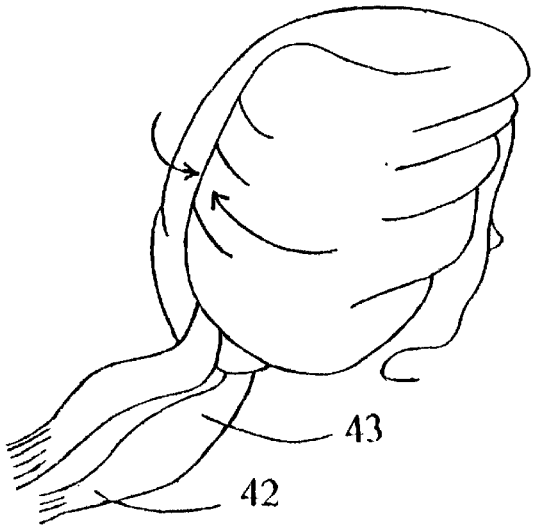
Figure 8I:
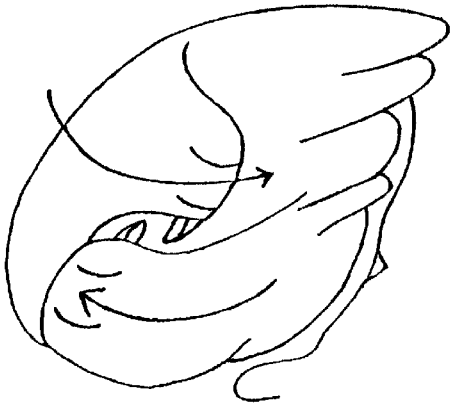
Figure 8E:
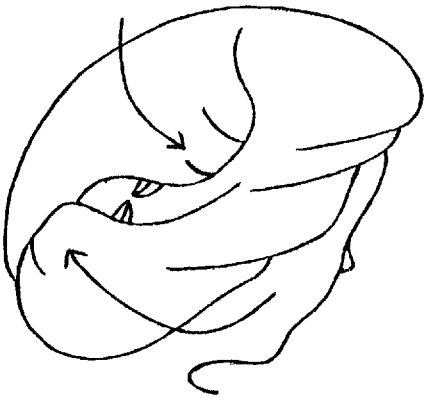
Figure 8F:
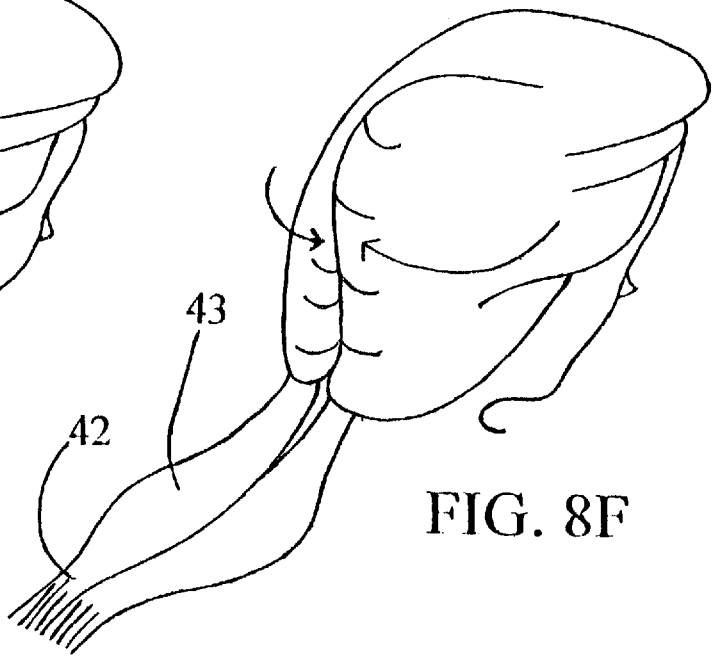
Figure 8J:
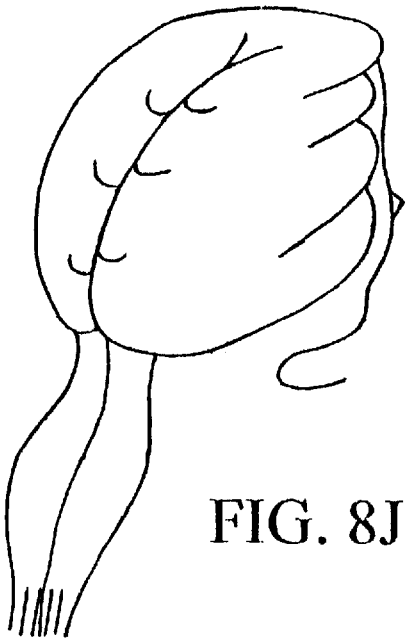

Therefore, fashioners 50 and 50A secure each other and the first and second hair groups in place (for example, FIG. 8G results in FIG. 8J; FIG. 5 shows how fashioners 50 and 50A interlock each other).

ADDITIONAL VARIATIONS OF UNIQUE WINDING HAIR STYLES

Figure 9A:
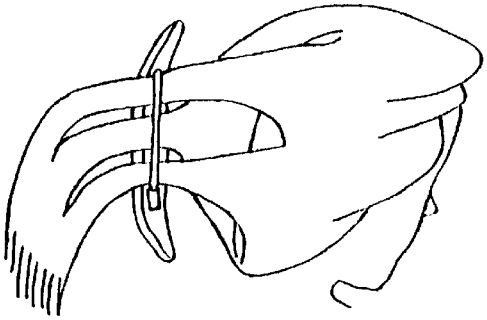
FIGS. 9A–9F illustrate additional variations of unique wound hair styles.
Figure 9B:
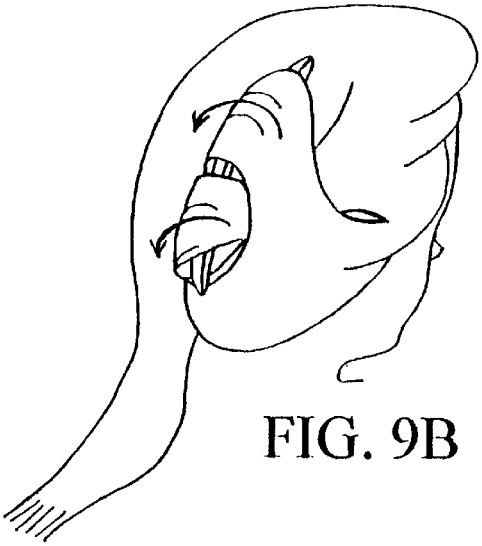
Figure 9C:
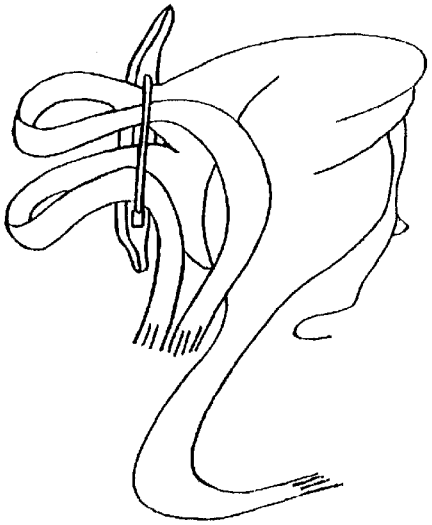
Figure 9D:
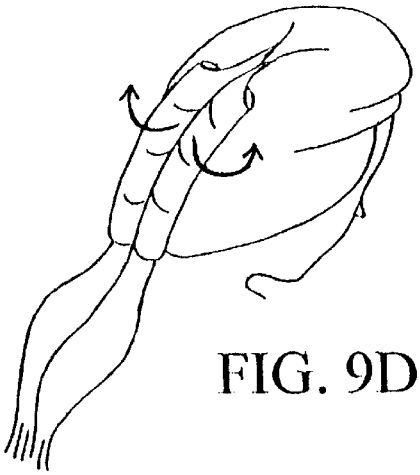
Figure 9E:
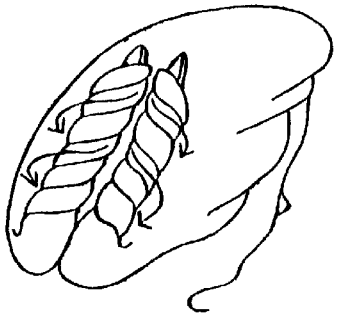
Figure 9F:
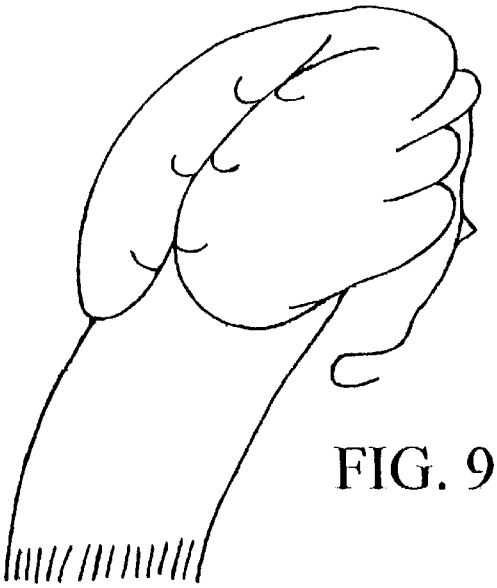

Hair strands of each hair group styled with each hair fashioner can:

(a) be a combination of many hair groups (for example, FIG. 9A);

(b) be gathered from the same or different sections on a head (for example, FIG. 9A);

(c) be placed parallel to or across one another (for example, FIG. 9B);

(d) be divided into or combined from many hair loops or hair tails (for example, FIG. 9C);

(e) be wound in either direction around each hair fashioner (for example, FIG. 9D);

(f) be wound around or helically along each hair fashioner (for example, FIG. 9E);

(g) be gathered from the sides of the head (for example, FIG. 9F).

Figure 9G:
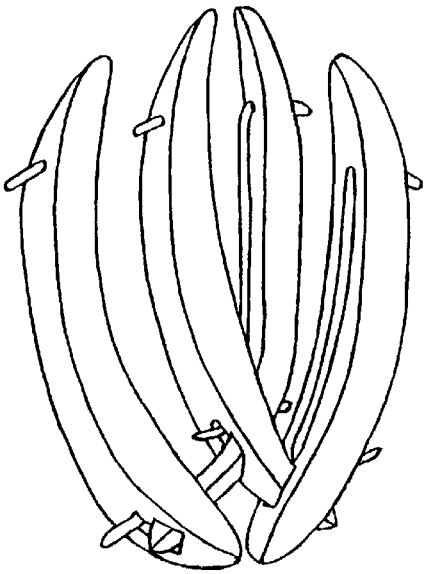
FIGS. 9G–9H illustrate still additional variations of unique wound hair styles using four hair fashioners.
Figure 9H:
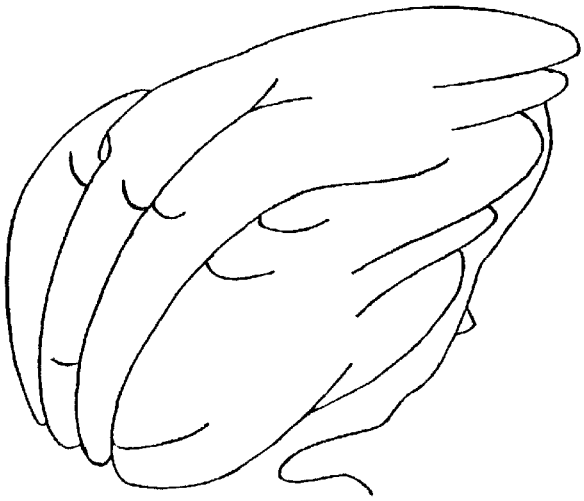

Further, with the same foregoing techniques, additional fashioners can be operated along with fashioners 50 and 50A to form additional variations of unique wound hair styles (for example, a combination of interlocked fashioners is shown without hair in FIG. 9G, and is shown with hair in FIG. 9H).

RAMMIFICATIONS AND EQUIVALENTS OF THE INVENTION

Figure 10A:
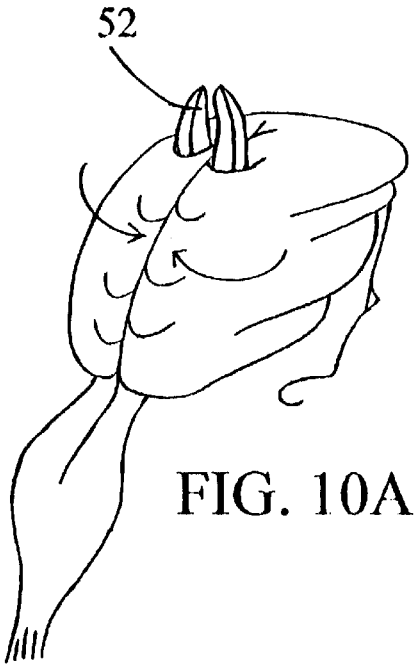
FIG. 10A–10I illustrate variations and equivalents of the hair fashioner.
Figure 10B:
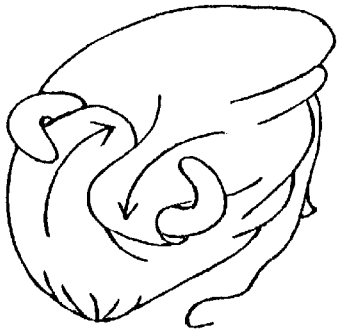
Figure 10C:
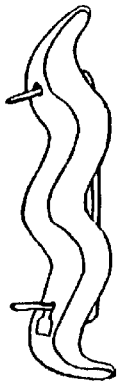
Figure 10D:
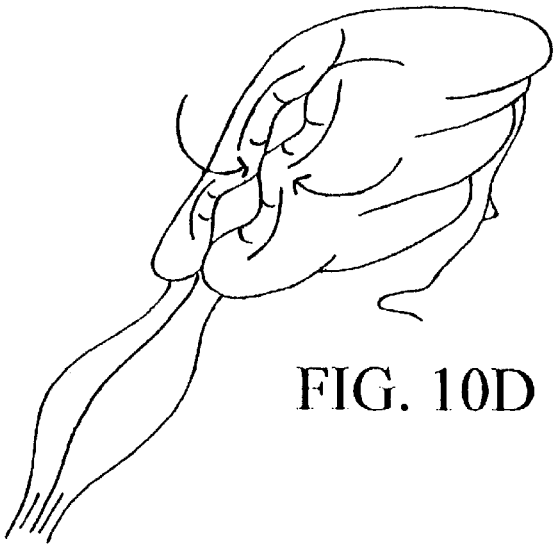
Figure 10E:
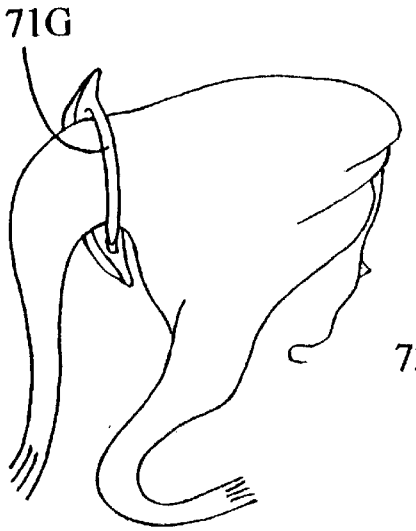
Figure 10F:
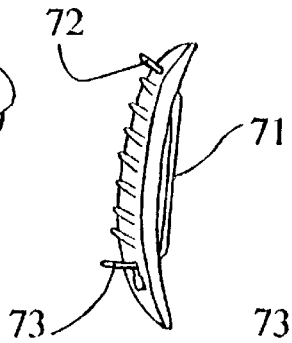
Figure 10H:
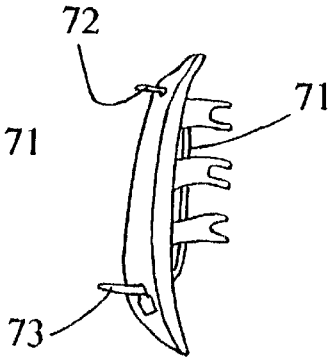
Figure 10G:
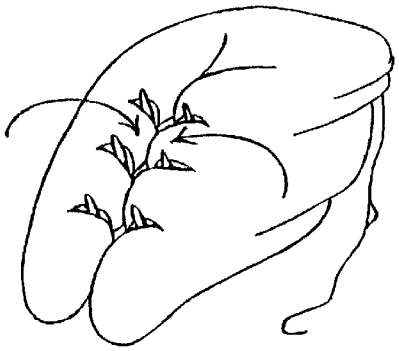
Figure 10I:
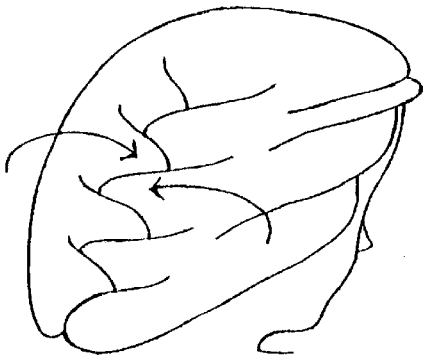
Figure 11A:
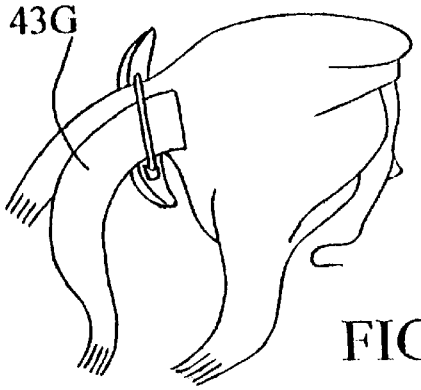
FIGS. 11A–11D, 12A, and 12K illustrate additional use and additional variations and equivalents of the hair fashioner.
Figure 11B:
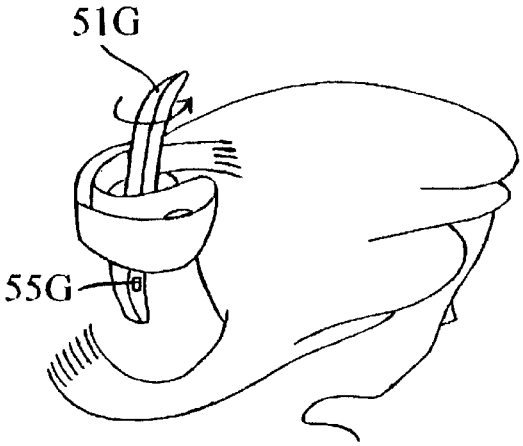
Figure 11C:
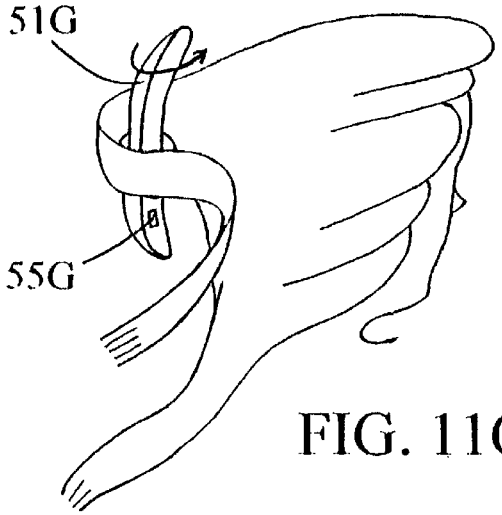
Figure 11D:
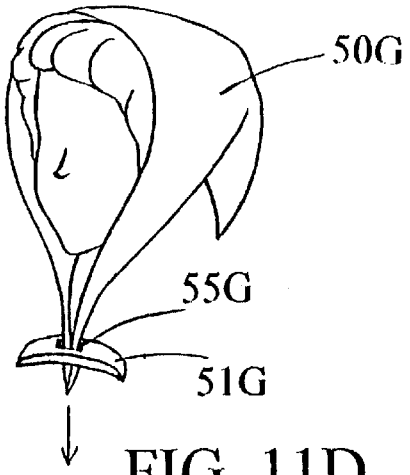
Figure 12K:
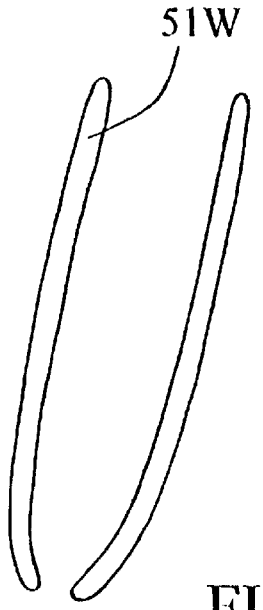
Figure 12A:
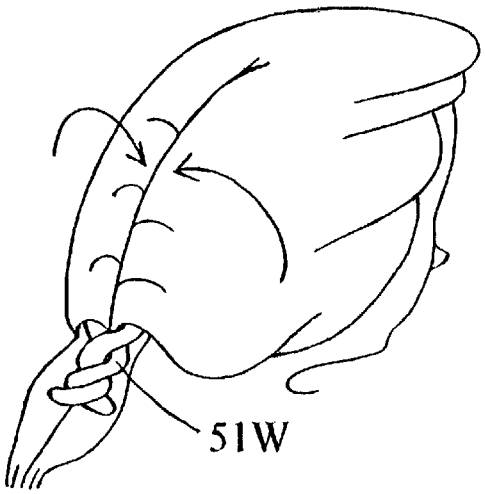
Figure 12B:
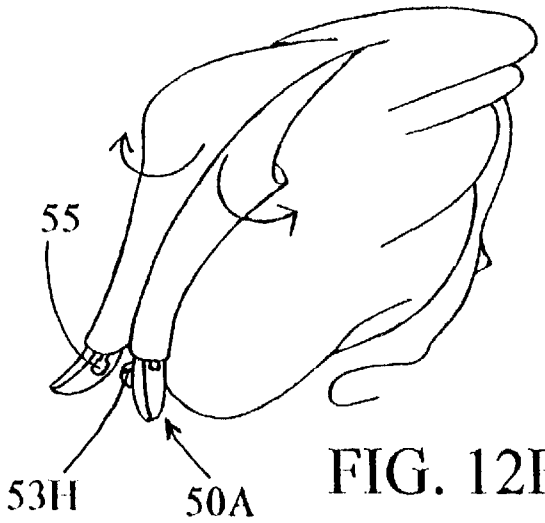
FIGS. 12B–12J illustrate additional techniques to couple the hair fashioners, using either an attached hand, a separate clamp, a separate pick, or a coupling device.

1) Each locking hole and locking slot of each hair fashioner can be located at any place on its base, including at the tip of its ends. Each fashioner can have many locking holes to interlock itself with many additional fashioners;

2) Each base end of each hair fashioner can be extended in any direction and angle (for example, FIG. 8J results in FIG. 10A; FIG. 8E results in FIG. 10B);

3) The cross-section of each base and each strap of each hair fashioner can vary in shape and size, such as being round or arched, thick or thin, solid or tubular, etc.;

4) Each base and each strap of each hair fashioner can be curved, straight or waved in any direction and angle (for example, FIG. 10C shows a waved base without hair; FIG. 10D shows 2 interlocked waved bases with hair, showing a gap between the hair fashioners and the head);

5) End 52 can be extended to form a fastening clasp or fastening tine 71G to replace strap 71 and hole 54. Fastening clasp or fastening tine 71G can flatten and fasten hair strands with its resilient force (for example: FIG. 10E);

6) Each base of each hair fashioner can have a plurality of teeth extending outward in any direction and angle, from any place on the base. Teeth can extend to a single point (for example, FIG. 10F shows a single-point-teeth base without hair; FIG. 10G shows 2 single-point-teeth bases with hair), or can extend to multi points (for example, FIG. 10H shows a double-point-teeth base without hair; FIG. 10I shows 2 double-point-teeth bases with hair). Hair can also be fastened between the teeth with their resilient forces;

7) Strap 71 can fasten a separate group of artificial hair 43G or real hair combined with a hair group from head (for example: FIG. 11A). Tips 72 and 73 can be press-locked together in locking hole 54, or be glued or otherwise attached to base 51;

8) Each fashioner can comprise a base 51G and a rectangular locking hole 55G. A hair group can be paired with each fashioner to form a loop (for example: FIG. 11B), or to form a tail (for example: FIG. 11C), then can be styled by applying the foregoing hair-styling techniques. Further, each fashioner can also be operated as a fastener. Two ends of a ribbon or a scarf 50G can be pulled through hole 55G to be locked in place (for example, FIG. 11D);

9) Each fashioner can comprise a metallic wire which can be formed of twistable or reconfigurable material such as copper, bronze, steel, etc. Each wire can be round or flat, solid or tubular, etc. Each wire can interlock a paired hair group to secure each other in place temporarily, separately from other wires, by being bent around the paired hair group to be intertwined with other wires. A wire 51W can be intertwined with another wire to secure each other and their paired hair groups in place (for example, FIG. 12K shows 2 separate wires without hair; FIG. 12A shows 2 intertwined wires with hair). If desired, each wire can also be covered with leather, rubber, foam, metal, cork, fabric, cotton, vinyl, nylon, plastic, etc., or the like;

10) A locking hand 53H can extend outward from any place on fashioner 50A's base, including from a tip of fashioner 50A's base end, and can be releasably press-locked into hole 55 to interlock fashioner 50 with fashioner 50A (for example, FIG. 12B).

Figure 12C:
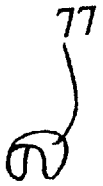
Figure 12D:
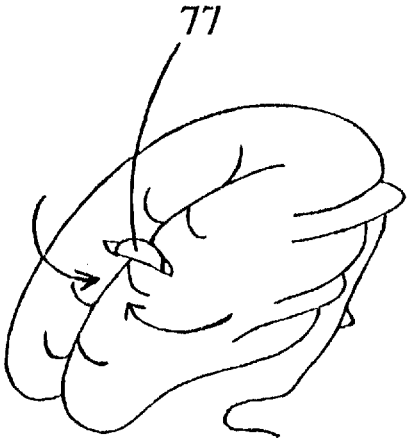
Figure 12E:
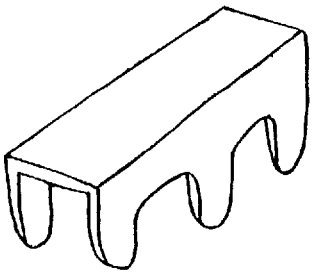
Figure 12F:
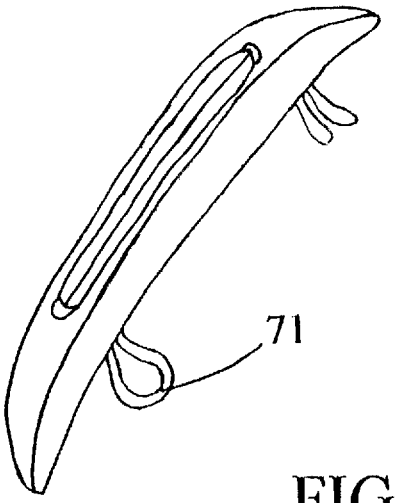
Figure 12G:
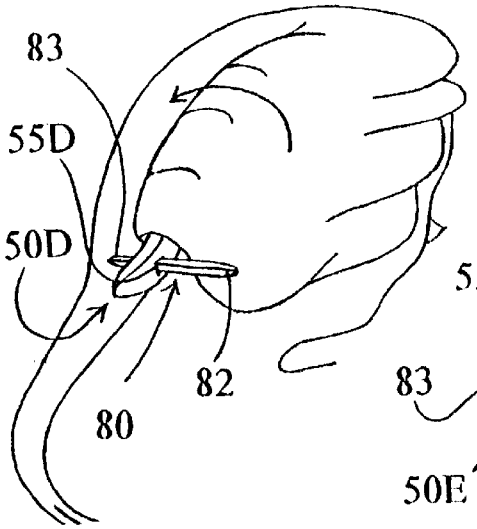
Figure 12H:
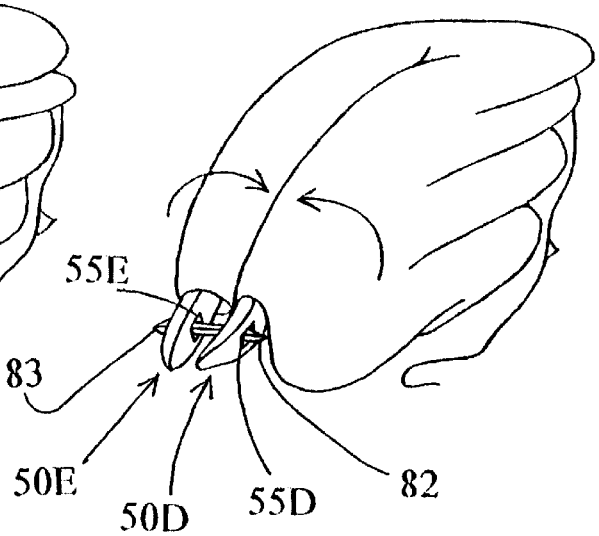
Figure 12I:
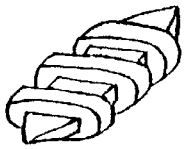
Figure 12J:
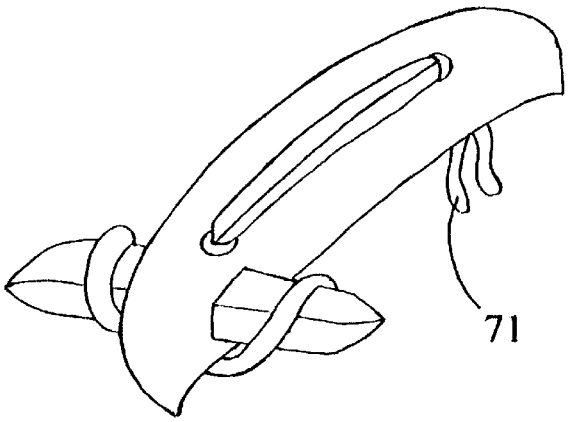

Alternatively, each hair fashioner can have a plurality of locking hands to interlock itself with many additional fashioners, either by being press-locked into locking holes of additional fashioners or by being snap-locked around bases of additional fashioners;

11) A resilient separate locking clamp 77 (for example: FIG. 12C) can be releasably snap-locked around both bases of fashioners 50 and 50A to interlock them with each other to secure them and their paired hair groups in place (for example, FIG. 12D). Alternatively, each clamp end can be divided into many smaller ends (for example: FIG. 12E) to divide a hair group into many smaller hair groups, thus creating additional hair styles;

12) Each base can have three locking holes, two round and one rectangular. A strap can be folded and press-locked through two round holes on each base to be locked in place (for example: FIG. 12F). The cross-section of each base is arched. A separate rectangular locking pick 80 has two ends 82 and 83. End 83 can be slid through a rectangular hole 55D of a fashioner 50D to secure fashioner 50D, its paired hair group, and pick 80 in place temporarily, separately from other fashioners and their paired hair group (for example, FIG. 12G). Further, end 83 can continue to be slid through an additional rectangular hole 55E of an additional fashioner 50E to interlock fashioners 50D and 50E with each other to secure them, their paired hair groups, and pick 80 in place (for example, FIG. 12H). Alternatively, a separate locking pick can be straight, curved, waved, U-shaped, or otherwise shaped; A separate locking pick's surface can be jagged (for example, FIG. 12I); A strap can be wrapped around a separate locking pick (for example, FIG. 12J); A separate locking pick can have a round cross-section and have male threads on its body to be screwed through round locking holes of fashioners which have mated female threads to interlock fashioners with one another.

CONCLUSION OF THE INVENTION

Thus, the reader will see that the hair fashioner of the invention provides a simple, highly reliable, lightweight, comfortable, versatile, quick-to-use, yet economical device that can be used by persons of almost any age. The hair fashioner is therefore inexpensive to manufacture and can be mass-produced by using an injection mold or stamp mold, etc.

Figure 13:
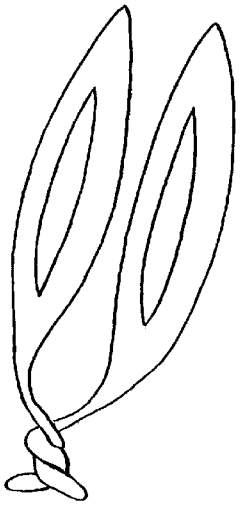
FIGS. 13, 14A–14Q illustrate additional variations and equivalents of the hair fashioners.
Figure 14A:
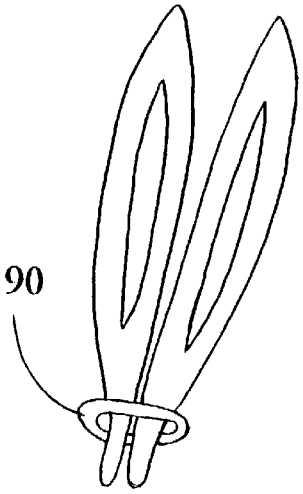
Figure 14B:
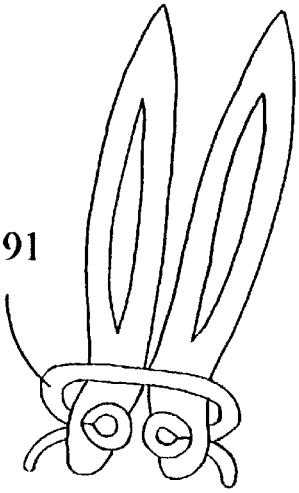
Figure 14C:
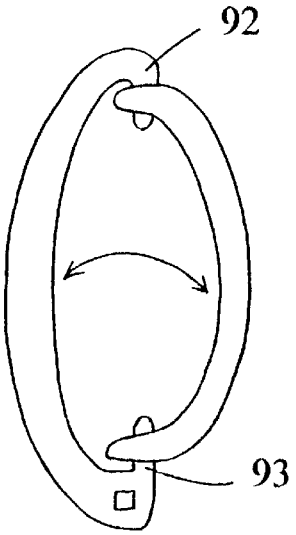
Figure 14D:
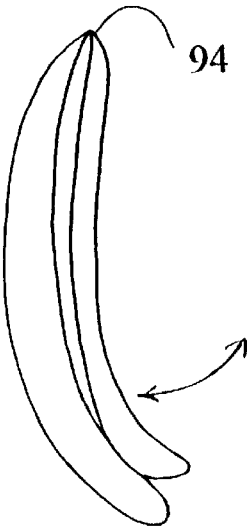
Figure 14E:
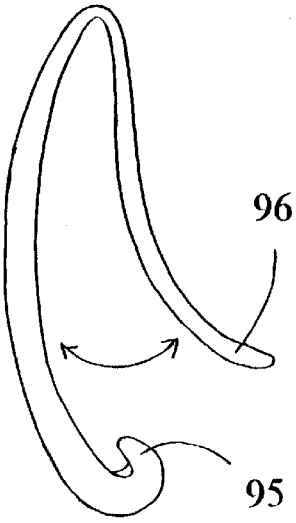
Figure 14F:
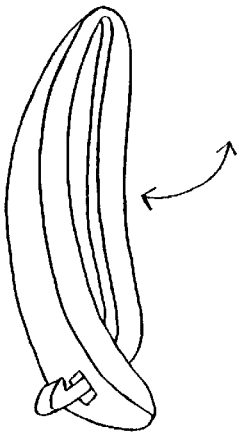
Figure 14G:
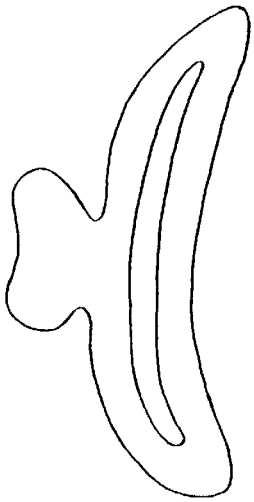

While only preferred embodiments, principles, and operation modes of the present invention have been illustrated and described in the foregoing drawings and descriptions, it is understood that the scope of the present invention is not limited to those examples of preferred embodiments thereof, but extends to a wide range of variations and equivalents. Some specific examples of variations and equivalents are:

- Scale changes will allow the present invention applications to expand where a smaller version could be used with doll's hair, string, thread, lace, scarf, ribbon, etc.; and a larger version could be used with other materials for purposes other than styling hair, such as creating patterns on curtains, drapes, etc;
- A locking hole and a locking slot can be combined into one single locking hole; each locking hole and locking slot can vary in shape and size (for example, oval, square, rectangular, or otherwise shaped); each locking hole and locking slot can be a through-hole or a recess.
- The cross-section of each base and each strap can vary in other shape and size (for example, half-mooned, flat, sectored, or otherwise shaped;
- Each base and strap can vary in shape and size in any direction and angle;
- The cross-section of each attached hand, separate clamp, or separate pick can vary in shape and size (for example, round, arched, solid, tubular, half-mooned, flat, triangular, oval, square, rectangular, or otherwise shaped);
- The hair fashioner can be partially or fully covered with foam, cork, fabric, vinyl, nylon, plastic, leather, rubber, metal, or the like.
- The hair fashioner can either be an predetermined open loop or a predetermined closed loop (for example, FIG. 13 shows two closed-loop hair fashioners coupled together), as mentioned earlier, each is capable of encompassing hair loosely or encompassing and fastening hair securely to prevent hair from going astray;
- Each attached hand, separate pick, and separate clamp can be replaced by an equivalent coupling device, or the like (for example, an elastic band, etc.) which is used to tie at least two fashioners together to couple them together (for example, FIGS. 14A, elastic band 90 replacing a separate clamp couples two fashioners together; FIG. 14B, elastic string 91 replacing a separate pick couples two fashioners together);
- Either an attached hand, a separate clamp, separate pick, a coupling device, or an equivalent coupling device can be used separately or together with any above coupling devices to couple at least two hair fashioners together;

The fastening clasp or tine can vary in shape and size like the strap;

The strap, the fastening clasp, or the fastening tine can be secured to a base releasably or permanently. Some examples are as follows: by hinge (for example, FIG. 14C shows a clasp attached to a base by hinges 92 and 93; FIG. 14D shows a clasp attached to a base by hinge 94), by hook (for example, FIG. 14E shows hook 95 for attaching end 96 of a clasp to a base), by hole, by a combination of hook and hole (for example, FIG. 14F), by press-locking, by snap-locking, by gluing, by welding, by molding, by riveting, by stamping, by heat-attaching, or otherwise secured;

Each hair fashioner portion can be extended in any direction and angle to form predetermined shapes or designs (for example, butterfly as in FIG. 14G, flower, or otherwise shaped);

The present invention can be applied on separate artificial or real hair groups such as wig.

Figure 14H:
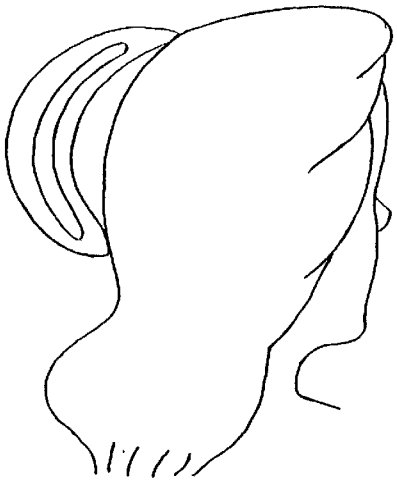

The strap and the base can be made as a single unit or an integral unit of one material, such as plastic, metal, etc., or in a plurality of parts secured together by: press-locking, snap-locking, gluing, welding, molding, riveting, stamping, heat-attaching, or otherwise secured together, which permits the strap and the base to be made of different materials (for example, the base could be made of semi-rigid plastic, while the strap is made of resilient metal);

Any portion of the base can extend in any direction and angle to create a strap, a fastening clasp, or a fastening tine;

Each hair fashioner can be made in any color or in any combination of colors;

FIG. 14H shows another example of the hair fashioner's shape, as mentioned earlier, which bubbles away from a user's head, creating a predetermined gap between the hair fashioner and the user's head to add additional fullness and style without adding additional material, weight, and cost to the hair fashioner.

The present invention can apply to hair gathered from any section or sections on the user's head.

Figure 14I:
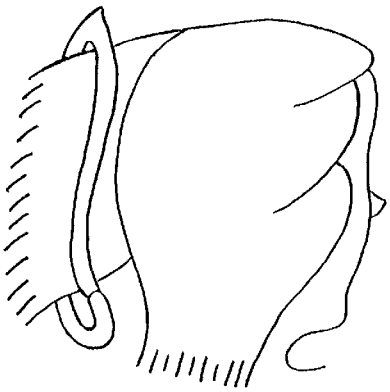

FIG. 14I shows an example of a hair fashioner, capable of styling short hair as mentioned earlier, fastening a short hair group at the root area of the hair group substantially close to the user's head.

It is noted that, as mentioned earlier, each hair fashioner having teeth, with respect to an adjacent hair fashioner having teeth or having no teeth, can be coupled with the adjacent hair fashioner in one of the following positions: parallel to each other; angular to each other; linear to each other; or across each other.

Coupling means can be covered partially or fully by hair of each of the hair styles.

Figure 14J:
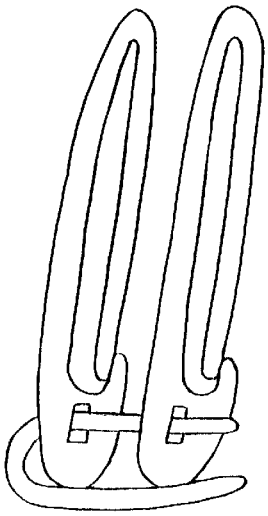
Figure 14K:
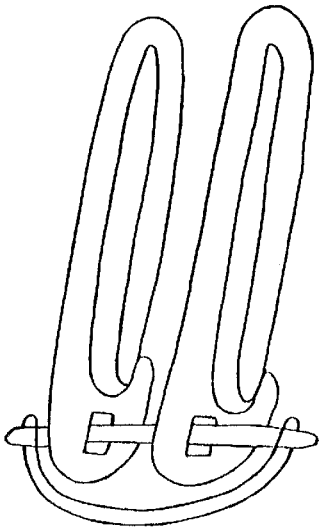
Figure 14L:
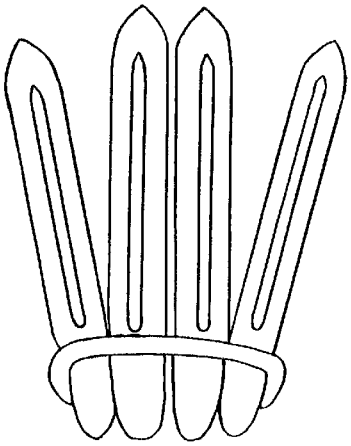
Figure 14N:
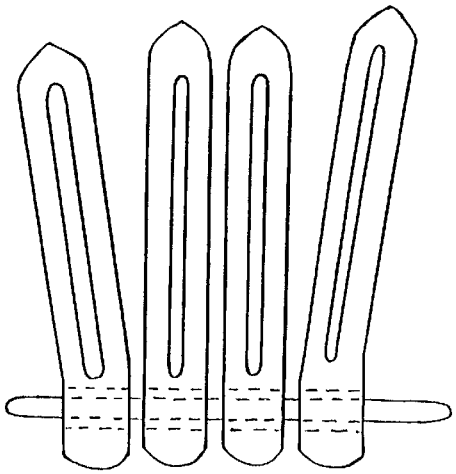
Figure 14M:
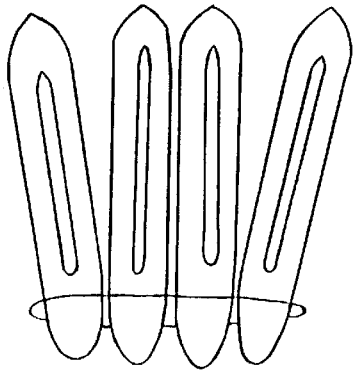
Figure 14O:
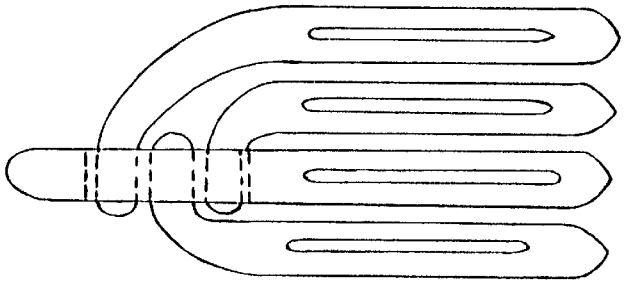
Figure 14P:
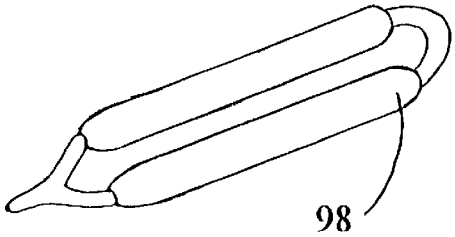
Figure 14Q:
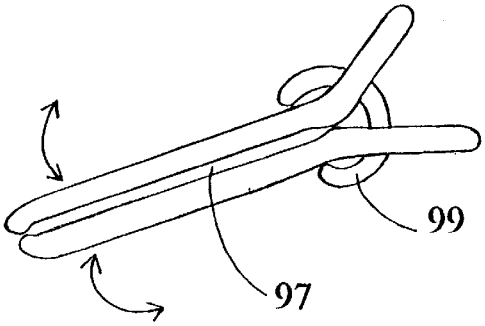

The structure, material, form, function, dimension, and operation mode of parts and elements of each hair fashioner can vary independently from those of parts and elements of other hair fashioners; Each foregoing hair fashioner variation and each foregoing hair-styling variation and method can be applied in any place, direction, and angle on head; Hair strands can be styled with any combination of the foregoing hair-styling variations and methods; Each hair fashioner can be formed of any combination of the foregoing hair-fashioner variations of parts and elements (for example: FIG. 14J shows a U-shaped pick; FIG. 14K shows a a combination of a straight pick and an elastic band; FIG. 14L shows a clamp coupling all hair fashioners together; FIG. 14M shows an elastic band coupling all hair fashioners together; FIG. 14N shows a separate pick inserted through a hole in each hair fashioner to couple all hair fashioners together; FIG. 14O shows a hair fashioner having a hole for one end of each other hair fashioner to be inserted through to couple all hair fashioners together; FIG. 14P shows a hair fashioner comprising a wire partially covered with a nylon layer 98; FIG. 14Q shows an example of an equivalent of the hair fashioner from FIG. 10E, this equivalent hair fashioner having a predetermined clamping hinge 99 capable of attaching a strap to a base and fastening hair securely in an opening 97).

In addition, each hair fashioner can also perform a variety of functions and styles found in a number of prior art. For example, the hair fashioner of the present invention can also invert a hair tail just like the hair styling tool in U.S. Pat. No. 5,036,870 issued Aug. 6, 1991, and can also invert a hair tail and prevent hair from going astray just like the hair styling tool in U.S. Pat. No. 5,289,834 issued Mar. 1, 1994. Further, the hair fashioner of the present invention can also create eleven additional hair styles which have been introduced to the public by the same hair styling tool in the U.S. Pat. No. 5,036,870 mentioned above.

Accordingly, all the previously-mentioned inventions teach a user how to style and secure each hair group independently. Further, by using the user's head as a locking means to secure each of the desired hair styles, or by using additional hair-holding devices to secure each of the desired hair styles, all the previously-mentioned inventions have a numerous disadvantages. Further, all the previously-mentioned inventions only work with substantially long and thick hair. Therefore, all the previously-mentioned inventions teach away from the present invention.

In contrast, the present invention teaches the user how to style and couple a plurality of hair groups to interlock the plurality of hair groups together, creating a wide variety of new, unique, and attractive hair styles never possible before. Therefore, these hair groups interact with one another and are self-secured. As a result, the present invention eliminates the need for using the user's head as a locking means to secure each of the desired hair styles, and also eliminates the need for using additional hair holding devices such as pins, clips, or the like to secure each of the desired hair styles. Further, the present invention can work with all short, long, thick, thin, straight, wavy hair. Further, the present invention also accomplishes numerous additional important advantages described earlier in the sections entitled "Objects and Advantages", and "Other Objects and Advantages". Therefore, the present invention teaches away from the previously-mentioned inventions.

Also, it is apparent to those skilled in the art that the present invention is capable of numerous variations of process, structure, material, color, form, function, dimension, operation mode, applications, alternatives, generalizations, equivalents, extensions, rearrangements, reshapings, reconfigurations, simplifications, additions, adaptations, modifications, optimizations, combinations, improvements, substitutions and so forth of the hair-styling methods and the hair fashioner's parts and elements without departing from the scope and spirit of the present invention which will be determined by the appended claims and their legal equivalents.

I claim:

1. A system of hair-styling tools comprising a plurality of interacting hair fashioners and predetermined coupling means for styling hair to create a variety of new, unique, and attractive hair styles, each of said hair fashioners comprising:

a predetermined strap having a first attaching end and a second attaching end, at least said first attaching end attached to a predetermined base to define a predetermined opening therebetween, said base having a coupling end.

2. The system of hair-styling tools of claim 1 wherein said hair fashioners and said coupling means made of a material selected from the group consisting of flexible material and resilient material and reconfigurable material and rigid material.

3. The system of hair-styling tools of claim 1 wherein each of said hair fashioners having a shape selected from the group consisting of relatively-straight shape and relatively-curved-body shape and relatively-curved-end shape and relatively-waved shape and relatively-curved-along-user's-head shape and relatively-bubbled-away-from-user's-head shape.

4. The system of hair-styling tools of claim 1 wherein said coupling means comprising said coupling ends which are capable of being twisted repeatedly without fracturing, said coupling ends intertwined together to couple said hair fashioners together.

5. The system of hair-styling tools of claim 1 wherein said coupling means comprising a clamping-tying device for clamping around said hair fashioners to couple said hair fashioners together.

6. The system of hair-styling tools of claim 1 wherein each of said straps and each of said bases having predetermined fastening forces for securely fastening hair in a respective one of said openings and for effectively preventing said hair from going astray when said hair passed therethrough.

7. The system of hair-styling tools of claim 1 wherein each of said second attaching ends releasably attached to a respective one of said bases and further each of said bases comprising predetermined locking means for releasably attaching a respective one of said second attaching ends to each of said bases.

8. The system of hair-styling tools of claim 7 wherein each of said locking means comprising a device selected from the group consisting of a hook for a respective one of said second attaching ends to be hooked on and a hole for a respective one of said second attaching ends to be hooked in.

9. The system of hair-styling tools of claim 1 further comprising predetermined dividing means attached to and extending out from each of said hair fashioners for performing a function selected from the group consisting of dividing hair into a plurality of smaller hair groups and decorating said hair as an ornament.

10. The system of hair-styling tools of claim 1 further comprising predetermined protecting means covering at least one portion of at least one of said hair fashioners for protecting and fastening hair passed through a respective one of said openings.

11. The system of hair-styling tools of claim 10 wherein said means being made of a material selected from a group consisting of foam and cork and fabric and vinyl and nylon and plastic and leather and rubber and metal.

12. A method of using the system of hair-styling tools of claim 1 for styling a plurality of hair groups, each of said hair groups having an end portion, a mid portion, and a root portion, said method comprising the steps of:

inserting a portion of a first hair group through an opening of a first hair fashioner;

rolling said first hair fashioner toward a root portion of said first hair group to wind said first hair group around said first hair fashioner;

inserting a portion of a second hair group through an opening of a second hair fashioner;

rolling said second hair fashioner toward a root portion of said second hair group in the opposite direction from the rolling direction of said first hair fashioner to wind said second hair group around said second hair fashioner; and coupling said first and second hair fashioners together by using said coupling means to interlock said first and second hair fashioners together, whereby said first and second hair fashioners and said first and second hair groups will be secured in place and form a new, unique, and attractive hair style of interacting hair groups.

13. The method of claim 12 further comprising the steps of:

inserting a portion of an additional hair group through an opening of an additional hair fashioner;

rolling said additional hair fashioner toward a root portion of said additional hair group to wind said additional hair group around said additional hair fashioner; and coupling said additional hair fashioner with one of said previously-coupled hair fashioners by using said coupling means to interlock said additional hair fashioner with that one of said previously-coupled hair fashioners, whereby said additional hair fashioner and said additional hair group will be secured in place and form an additional new, unique, and attractive hair style of interacting hair groups.

14. The method of claim 13 further comprising the step of:

applying all the steps of claim 13 in said order for each of the rest of additional hair fashioners to style additional hair, whereby each of the rest of said additional hair fashioners and said additional hair will be secured in place and form additional new, unique, and attractive hair styles of interacting hair groups.

15. The method of claim 12 wherein any two adjacent ones of said hair fashioners, with respect to each other, secured in a position selected from the group consisting of relatively-facing-each-other position and relatively-one-overlaying-another position and relatively-side-by-side position and relatively-one-on-top-another position and relatively-parallel-to-each-other position and relatively-angular-to-each-other position and relatively-linear-to-each-other position and relatively-across-each-other position.

16. The method of claim 14 wherein any two adjacent ones of said hair groups, with respect to each other, secured in a position selected from the group consisting of relatively-facing-each-other position and relatively-one-overlaying-another position and relatively-side-by-side position and relatively-one-on-top-another position and relatively-parallel-to-each-other position and relatively-angular-to-each-other position and relatively-linear-to-each-other position and relatively-across-each-other position.

17. The method of claim 14 wherein each of said hair groups wound around a respective one of said hair fashioners covering said respective hair fashioner in a manner selected from a group consisting of partially covering said respective hair fashioner and fully covering said respective hair fashioner.

18. The method of claim 14 wherein said sections of said hair groups inserted through said openings being only the mid portions of said hair groups so that the end portions of said hair group are not passed through said openings to form hair loops.

19. The method of claim 14 wherein each of said hair groups securely fastened in a respective one of said openings and prevented from going astray.

20. The method of claim 14 wherein each of said hair fashioners securely fastening a respective one of said hair groups in a respective one of said openings at the root portion of the respective one of said hair groups.

21. A method of using the system of hair-styling tools of claim 9 for styling a plurality of hair groups, each of said hair groups having an end portion, a mid portion, and a root portion, said method comprising the steps of:

inserting a portion of a first hair group through an opening of a first hair fashioner;

rolling said first hair fashioner toward a root portion of said first hair group to wind said first hair group around said first hair fashioner;

inserting a portion of a second hair group through an opening of a second hair fashioner;

rolling said second hair fashioner toward a root portion of said second hair group in the opposite direction from the rolling direction of said first hair fashioner to wind said second hair group around said second hair fashioner; and coupling said first and second hair fashioners together by using said coupling means to interlock said first and second hair fashioners together, whereby said first and second hair fashioners and said first and second hair groups will be secured in place and said first and second hair groups will be divided into many smaller hair groups and form an additional new, unique, and attractive hair style of interacting hair groups.

22. The method of claim 21 further comprising the step of incorporating a separate foreign hair group to at least one of said hair groups before applying the first step of inserting hair through an encompassing opening.

23. The method of claim 21 wherein said first and second hair groups, with respect to each other, secured in a position selected from the group consisting of relatively-facing-each-other position and relatively-one-overlaying-another position and relatively-side-by-side position and relatively-one-on-top-another position and relatively-parallel-to-each-other position and relatively-angular-to-each-other position and relatively-linear-to-each-other position and relatively-across-each-other position.

24. The method of claim 21 wherein each of said first and second hair groups securely fastened in a respective one of said openings and prevented from going astray.

* * * * *